US010856654B2

(12) United States Patent
McDonald et al.

(10) Patent No.: US 10,856,654 B2
(45) Date of Patent: Dec. 8, 2020

(54) PORTABLE WORKSTATION APPARATUS

(71) Applicants: Richard McDonald, Seminole, FL (US); Curt Schlager, Pinellas Park, FL (US)

(72) Inventors: Richard McDonald, Seminole, FL (US); Curt Schlager, Pinellas Park, FL (US)

( * ) Notice: Subject to any disclaimer, the term of this patent is extended or adjusted under 35 U.S.C. 154(b) by 0 days.

(21) Appl. No.: 16/723,501

(22) Filed: Dec. 20, 2019

(65) Prior Publication Data

US 2020/0121075 A1 Apr. 23, 2020

(51) Int. Cl.

| | |
|---|---|
| ***A47B 37/04*** | (2006.01) |
| ***A47B 77/06*** | (2006.01) |
| *A45B 23/00* | (2006.01) |
| *A47B 3/10* | (2006.01) |

(52) U.S. Cl.

CPC ..... *A47B 37/04* (2013.01); *A47B 77/06* (2013.01); *A45B 2023/0012* (2013.01); *A45B 2200/1063* (2013.01); *A47B 3/10* (2013.01)

(58) Field of Classification Search

CPC ... A47B 37/04; A47B 31/02; A47B 2031/008; A47B 2031/026; A45B 2200/1063

USPC ..... 108/50.12, 50.13, 50.11, 50.18, 26, 25, 108/24

See application file for complete search history.

(56) References Cited

U.S. PATENT DOCUMENTS

| | | | | | |
|---|---|---|---|---|---|
| 116,419 | A * | 6/1871 | Drane | B64C 11/003 | 416/87 |
| 184,340 | A * | 11/1876 | Cassiano | B01L 9/02 | 108/24 |
| 206,845 | A * | 8/1878 | Wells | A47B 37/00 | 108/50.13 |
| 273,905 | A * | 3/1883 | Spelman | F24H 3/006 | 237/17 |
| 575,711 | A * | 1/1897 | Haley | F21S 6/001 | 108/50.13 |
| 1,127,064 | A * | 2/1915 | Mills | A47B 31/02 | 126/268 |
| 3,983,583 | A * | 10/1976 | Herman | A47B 69/00 | 62/331 |
| 4,161,234 | A * | 7/1979 | Munn | A47B 31/00 | 186/52 |
| 6,298,866 | B1 * | 10/2001 | Molnar, IV | A45B 3/00 | 108/50.12 |
| 6,516,729 | B1 * | 2/2003 | Dodson | A47B 37/04 | 108/1 |
| 6,796,319 | B1 * | 9/2004 | Patarra | A45B 11/00 | 108/138 |

(Continued)

*Primary Examiner* — Jose V Chen

(74) *Attorney, Agent, or Firm* — Barry Choobin; Patent 360

(57) ABSTRACT

Disclosed is a portable workstation apparatus including a flat workbench having a top surface and a bottom surface, the workbench having a proximal end and a distal end. A rod is detachably coupled to the distal end of the workbench. A pair of rails is coupled to the bottom side of the workbench and a sink unit is slidably mounted to the pair of rails. A dispenser is coupled to the proximal end of the workbench, wherein the dispenser and the rod upstands on the ground for supporting the workbench at a predetermined height, the dispenser configured to make ice cubes. A storage unit is mounted on the dispenser. An umbrella having a canopy and a shaft, is coupled to the storage unit.

6 Claims, 2 Drawing Sheets

(56) References Cited

U.S. PATENT DOCUMENTS

| | | | | |
|---|---|---|---|---|
| 7,066,096 | B1 * | 6/2006 | Harker | B60R 15/02 108/44 |
| 7,101,000 | B2 * | 9/2006 | DeMars | A47F 9/00 108/50.12 |
| 7,537,015 | B1 * | 5/2009 | Molnar, IV | A45B 23/00 108/50.12 |
| 7,585,552 | B2 * | 9/2009 | Meseke | G09F 19/08 108/50.12 |
| 8,640,894 | B1 * | 2/2014 | Cronin | A47B 97/00 108/183 |
| 9,706,820 | B1 * | 7/2017 | Lopez | A45F 3/44 |
| 2006/0124157 | A1 * | 6/2006 | Bayour | A45B 23/00 135/16 |
| 2011/0265694 | A1 * | 11/2011 | Portis | A45B 3/00 108/50.12 |
| 2013/0186306 | A1 * | 7/2013 | Thornley | A47B 3/00 108/24 |
| 2014/0069304 | A1 * | 3/2014 | Elstad | A47F 10/06 108/26 |
| 2017/0302101 | A1 * | 10/2017 | Varacek | A45B 23/00 |
| 2018/0000241 | A1 * | 1/2018 | Wei | A45B 25/02 |
| 2018/0332961 | A1 * | 11/2018 | Butler | A47B 37/04 |

* cited by examiner

PORTABLE WORKSTATION APPARATUS

FIELD OF THE INVENTION

The present invention relates to working table apparatuses. More specifically, the present invention relates to an apparatus that provides a hassle-free arrangement to perform desk job without the need to stand up to fulfill basic necessities.

BACKGROUND OF THE INVENTION

Working in natural environment rather than in a compact space is more preferred by the people. But it is difficult to work outside due to uneven environmental conditions which include rainfall or sunburn. Conventionally a table with an umbrella mounted on it was used to perform desk work outside. But it was difficult to work on this apparatus as it does not have socket to charge a laptop or phone.

To overcome the problem of charging electronic devices while doing desk work outside, another working table was introduced. This includes a charging socket to charge any electronic device but it was difficult to work on this table in the night as there was no lighting system attached to carry on the work at night.

JPH05225812A discloses about a table lamp which has a desired size for use and allows its size to be reduced for easy storage while it is out of use. A table lamp comprises a supporting pole 9 supporting a light source 6, supporting member 13, supporting ring 11, frame 12, flange 10, and supporting member 13. The member 16 is provided around the light source 6 and opens from one end to the other end to form a hood with an umbrella sheet. The supporting ring 11 and frame 12 are fixed to one end of the supporting pole 9 to support the member 16. The flange 10 is inserted into the supporting pole 9 and can slide in the axial direction of the supporting pole 9. The supporting member 13 connects the member 16 and flange 10. The table lamp comprises drive coils 1a, 1b of a shape memory alloy which expands or contracts the flange 10 to move it in the axial direction of the supporting pole 9 and opens or closes the member 16 around its one end. In addition, the table lamp comprises an electric circuit which heats the drive coils 1a, 1b by applying electric currents to them.

The disadvantage the prior art is that the invention helps the user in working outside at night by providing inbuilt lights but there is a risk of theft in working outside at night so the user may lose his/her belongings while working.

GB2525255A discloses about an Modular interlocking furniture comprises a number of elements with cavities e.g. open and/or closed cavities, which allow one or more elements to be interlocked together, thereby allowing the furniture to be constructed via the interlocking of a number of elements to form the desired furniture, and sustain itself without the requirement of conventional fastening means e.g. screws, nails, bolts. Additional elements may be placed within the joints to increase the stability of the furniture. The elements may include channels to allow one or more doors to be incorporated into the furniture and have cavities may be located in different positions to allow the elements once connected to form the desired furniture. The furniture can be in the form of a shelving unit, cupboard, cabinet and table or chair for example. The elements may be made from wood, mfd, plywood or plastic.

The prior art discussed in above paragraph provides a table type platform to work in outdoor environment with a cupboard to protect the belongings of the user from being theft while working in night but the invention is not portable and does not provide utility for using it on beaches to wash fishes or utensils while sitting.

In order to provide a portable arrangement for performing desk job in natural environment, there is a need to provide an apparatus to work outside without the need to stand up for basic necessities like washing any stuff or placing the belongings safely.

OBJECTS OF THE INVENTION

The principal object of the present invention is to overcome the disadvantages of the prior art.

An object of the present invention is to provide an apparatus for helping the user in performing desk work by fulfilling basic necessities of a user during a desk job.

Another object of the present invention is to provide an apparatus for protecting user from uneven environmental conditions.

Yet another object of present invention is to provide a portable hassle-free arrangement for cleaning fishes and utensils near a beach or any other location.

The foregoing and other objects, features, and advantages of the present invention will become readily apparent upon further review of the following detailed description of the preferred embodiment as illustrated in the accompanying drawings.

SUMMARY OF THE INVENTION

The present invention discloses about portable workstation apparatus to fulfill basic requirements of a user while performing a desk job.

According to an embodiment of the present invention, a portable workstation comprising, a supporting assembly installed in the apparatus for placing desk work components of a user, a rod attached to a first side of the supporting assembly for lifting the supporting assembly in one position, a housing assembly connected to the first side of the supporting assembly for washing a stuff of the user, a dispenser attached to the first side of the supporting assembly for providing ice cubes to the user, wherein the dispenser hold the supporting assembly in one position, a storage mounted on the dispenser unit for storing belongings of the user and an umbrella associated to a second side of the supporting assembly to protect the user from uneven environmental conditions.

While the invention has been described and shown with particular reference to the preferred embodiment, it will be apparent that variations might be possible that would fall within the scope of the present invention.

BRIEF DESCRIPTION OF THE DRAWINGS

Embodiments of the present disclosure will now be described, by way of example only, with reference to the following diagram wherein.

DETAILED DESCRIPTION OF THE INVENTION

The following description includes the preferred best mode of one embodiment of the present invention. It will be clear from this description of the invention that the invention is not limited to these illustrated embodiments but that the invention also includes a variety of modifications and embodiments thereto. Therefore, the present description should be seen as illustrative and not limiting. While the invention is susceptible to various modifications and alternative constructions, it should be understood, that there is no intention to limit the invention to the specific form disclosed, but, on the contrary, the invention is to cover all modifications, alternative constructions, and equivalents falling within the spirit and scope of the invention as defined in the claims.

In any embodiment described herein, the open-ended terms "comprising," "comprises," and the like (which are synonymous with "including," "having" and "characterized by") may be replaced by the respective partially closed phrases "consisting essentially of," consists essentially of," and the like or the respective closed phrases "consisting of," "consists of, the like.

As used herein, the singular forms "a," "an," and "the" designate both the singular and the plural, unless expressly stated to designate the singular only.

The present talks about portable workstation for doing desk job without any hassle. The invention makes the desk work convenient in natural environment by providing various necessary requirements to work near beach or at backyard.

Figure 1:
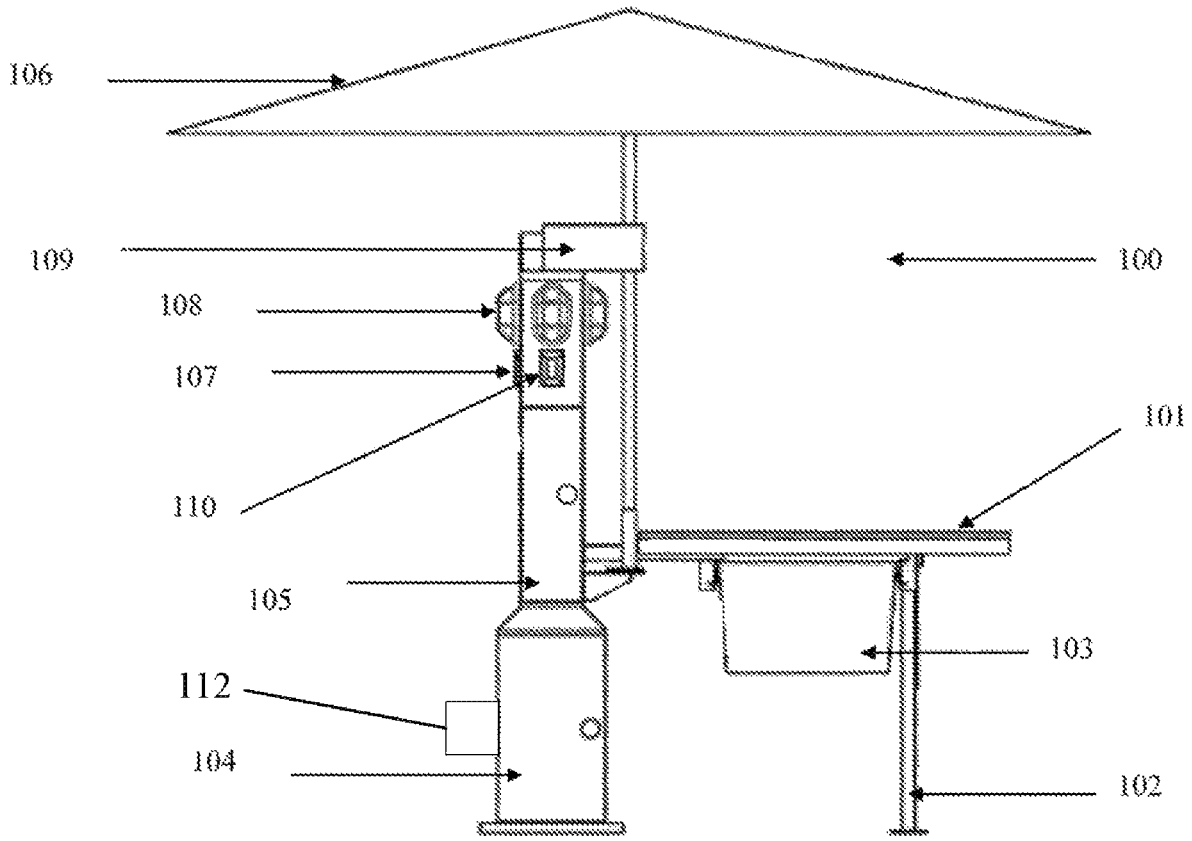
FIG. 1 illustrates a schematic view of the portable workstation apparatus.

Referring to FIG. 1, illustrates schematic view of the portable workstation apparatus 100, wherein the apparatus 100 comprises, a supporting assembly 101 is installed in the apparatus 100. The supporting assembly 101 is for placing components of the user.

The components may include but not limited to fishing rod, bucket, laptop, books and alike. The supporting assembly 101 is preferably in rectangular shape. Due to the rectangular shape it takes less space to adjust. The supporting assembly 101 is preferably made up of wooden material.

The rod 102 is attached to a first side of the supporting assembly 101. The first side is the bottom side. The rod 102 is for lifting the supporting assembly 101 in one position. The position is basically the horizontal position. The rod 102 is a detachable in nature so when the apparatus 100 needed to be transfer from one place to another than the rod 102 is detach from the bottom side and the supporting assembly 101 is folded to form a vertical position.

Figure 2:
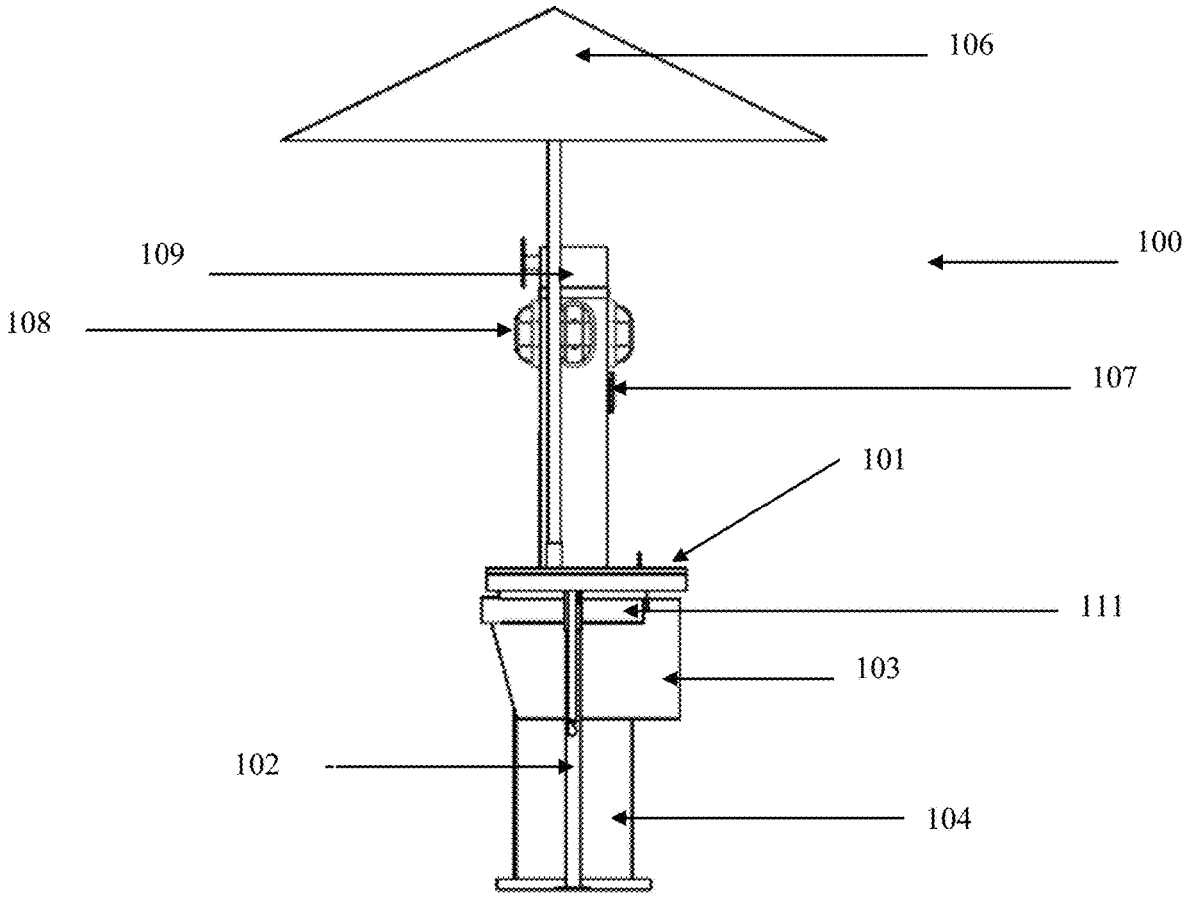
FIG. 2 illustrates a side view of the portable workstation apparatus.

Referring to FIG. 2, the housing assembly 103 is connected to the bottom side of the supporting assembly 101. The housing assembly 103 is basically a sink 103 for washing various stuff of the user. The stuff may include but not limited to fishes, utensils or any other washable material. The sink 103 is connected to the supporting assembly 101 in such a way that the sink 103 is slide in/out for putting the fishes or utensils needed to be washed. To slide the sink in/out a sliding rail 111 is attached at the bottom side of the supporting assembly.

The dispenser 104 attached to the bottom side of the supporting assembly 101. The dispenser 104 is basically an ice maker 104 which provides ice cubes instantly to the user. Due to the attachment of ice maker 104 at the bottom side of the supporting assembly 101, the ice maker holds the supporting assembly 101 in the horizontal position.

The storage unit 105 is mounted on the ice maker 104. The storage unit 105 is for storing the belongings of the user to protect them from being theft and also from the splashes of water. The belongings may include but not limited to bag, helmet and alike. The storage unit 105 also consists of a locking mechanism to keep the belongings safe. Above the storage unit 104, a socket 107 is provided to charge electronic devices.

Numbers of lights 108 are mounted above the storage unit. The lights 108 are attached in the apparatus 100 for providing a better vision during the evening as there is no sunlight. A switch 110 is also embedded below the lights 108. The switch 110 is to turn the lights 108 on/off according to the requirement. On the upper part of the lights 108, a fan 109 is mounted. The fan 109 is to provide cool air to the user.

An umbrella 106 is associated with a second side of the supporting assembly 101. The second side is the upper side of the supporting assembly 101. The umbrella 106 is to protect the user from uneven environmental conditions. The uneven environmental conditions include rainfall, sunburn, snowfall and alike.

A battery 112 is attached to the apparatus 100. The battery 112 provides electrical power to the lights and fan attached to the apparatus 100. The apparatus 100 may place anywhere as it does not require electrical power from any other source.

The user does not need to face much difficulty in performing desk work in natural environment as the invention provides a platform to execute the desk related task without getting messed up due to different types of stuff lying on the workstation. The invention provides facility to place the stuff at different sections as per the requirement.

Although the field of the invention has been described herein with limited reference to specific embodiments, this description is not meant to be construed in a limiting sense. Various modifications of the disclosed embodiments, as well as alternate embodiments of the invention, will become apparent to persons skilled in the art upon reference to the description of the invention.

We claim:

1. A portable workstation apparatus, comprising;

a flat workbench having a top surface and a bottom surface, the workbench having a proximal end and a distal end;

a rod of a predetermined length detachably coupled to the distal end of the workbench;

a pair of rails coupled to the bottom side of the workbench a sink unit slidably mounted to the pair of rails;

a dispenser coupled to the proximal end of the workbench, wherein the dispenser and the rod upstand on a ground for supporting the workbench at a predetermined height, the dispenser configured to make ice cubes;

a storage unit mounted on the dispenser, the storage unit secured by a lock; and an umbrella having a canopy and a shaft, the shaft in an upstanding position coupled to the storage unit, the canopy in an open position covers the top surface of the workbench.

2. The apparatus of claim 1, wherein the apparatus further comprises a plurality of lights mounted on the storage unit.

3. The apparatus of claim 2, wherein the apparatus further comprises a fan mounted on the storage unit.

4. The apparatus of claim 3, wherein the apparatus further comprises a battery to power the dispenser, the plurality of lights, and the fan.

5. The apparatus of claim 4, wherein the apparatus further comprises a charging socket configured in the storage unit, the charging socket electrically connected to the battery and configured for charging a portable computing device.

6. The apparatus of claim 1, wherein the rod detaches to fold the workbench.

* * * * *